United States Patent [19]

Gray et al.

[11] 4,155,729

[45] May 22, 1979

[54] LIQUID FLASH BETWEEN EXPANDERS IN GAS SEPARATION

[75] Inventors: Michael L. Gray; Robert M. Bellinger, both of Bartlesville, Okla.

[73] Assignee: Phillips Petroleum Company, Bartlesville, Okla.

[21] Appl. No.: 844,088

[22] Filed: Oct. 20, 1977

[51] Int. Cl.[2] ..... F25J 3/02

[52] U.S. Cl. ..... 62/18; 62/28; 62/38; 62/23

[58] Field of Search ..... 62/38, 39, 27, 28, 23, 62/18

[56] References Cited

U.S. PATENT DOCUMENTS

| | | | |
|---|---|---|---|
| 1,607,322 | 11/1926 | Van Nuys et al. | 62/39 |
| 2,265,558 | 12/1941 | Ward et al. | 62/23 |
| 2,880,592 | 4/1959 | Davison et al. | 62/25 |
| 2,903,858 | 9/1959 | Bocquet | 62/39 |
| 3,292,380 | 12/1966 | Bucklin | 62/20 |
| 3,292,381 | 12/1966 | Bludworth | 62/27 |
| 3,319,429 | 5/1967 | Pryor | 62/28 |
| 3,516,261 | 6/1970 | Hoffman | 62/28 |
| 3,702,541 | 11/1972 | Randall et al. | 62/28 |
| 4,061,481 | 12/1977 | Campbell et al. | 62/38 |

FOREIGN PATENT DOCUMENTS

| | | | |
|---|---|---|---|
| 885433 | 11/1971 | Canada | 62/27 |

*Primary Examiner*—Norman Yudkoff

[57] ABSTRACT

In the separation of low boiling gases such as ethane and heavier from natural gas utilizing two expanders in series, liquid condensed before expansion is not passed to the fractionator but is flashed and the resulting vapor combined with the expanded vapor from the first expander. This results in both increased work output from the second expander and simplified design of the downstream fractionator column since it reduces the amount of lighter materials introduced into the lower section thereof.

9 Claims, 1 Drawing Figure

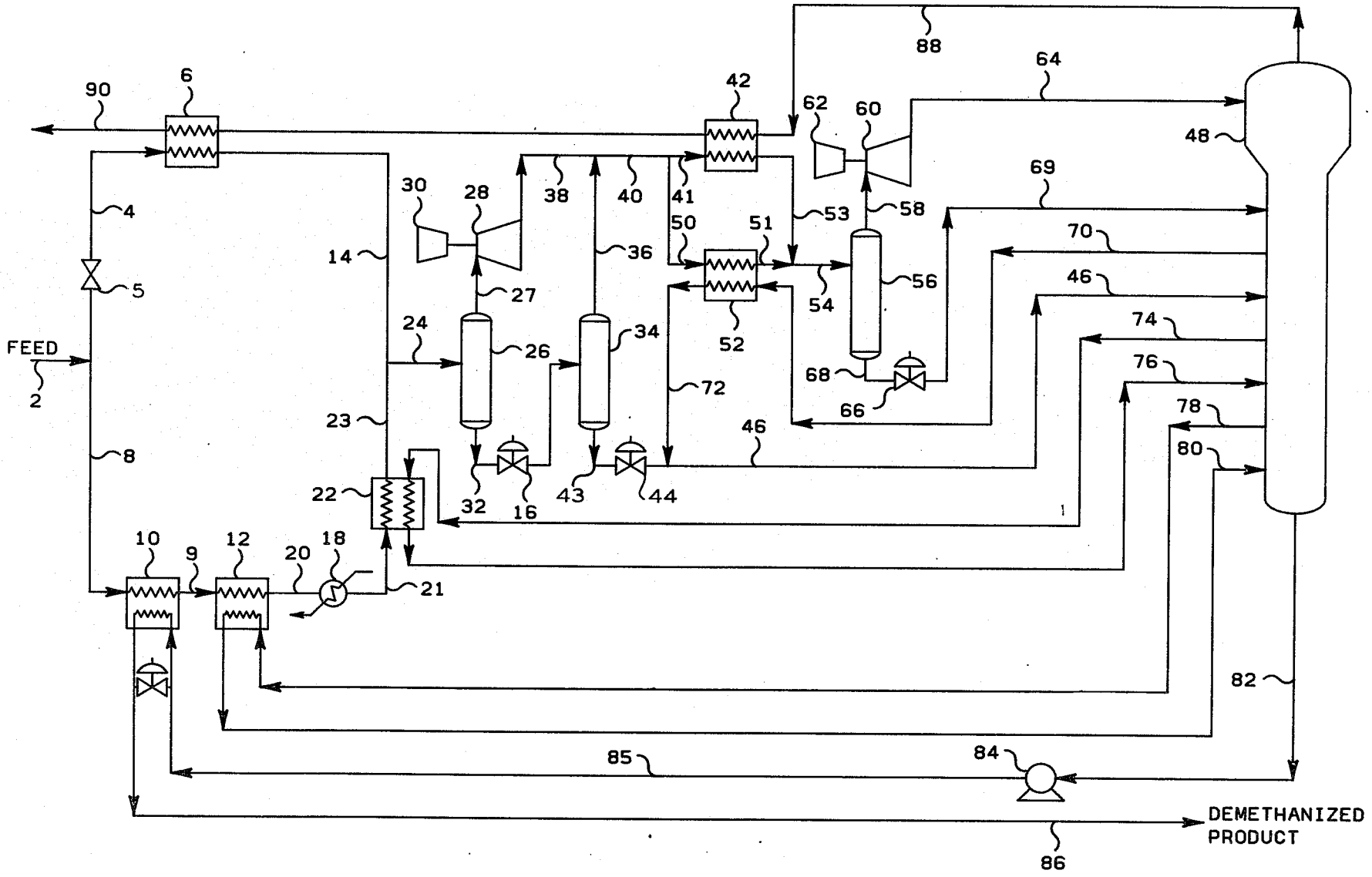
DEMETHANIZED PRODUCT
FEED
2
4
5
6
8
9
10
12
14
16
18
20
21
22
23
24
26
27
28
30
32
34
36
38
40
41
42
43
44
46
48
50
51
52
53
54
56
58
60
62
64
66
68
69
70
72
74
76
78
80
82
84
85
86
88
90

LIQUID FLASH BETWEEN EXPANDERS IN GAS SEPARATION

BACKGROUND OF THE INVENTION

This invention relates to the separation of higher molecular weight components from lower molecular weight components in a fluid stream. In a specific embodiment, it relates to the separation of the ethane and higher molecular weight components from a natural gas stream containing methane.

Natural gas as it comes from the ground generally is not suitable for use directly without some processing. The basic processing operations carried out in a natural gas plant are to first remove acid gases such as $CO_2$ and $H_2S$ and then to pass the gas through a dehydration means to remove water. The resulting product can then be used as a fuel. However, such streams generally contain a substantial amount of higher molecular weight components such as ethane and to a lesser extent, propane, butanes, and higher components. The ethane and heavier components are of greater value as chemical feedstocks than they are as a fuel.

It has long been known to separate ethane and higher components from methane by the use of an expander wherein a natural gas feedstream is passed to a high pressure separator and the vapor taken off and passed to an expander with the resulting vapor going to the upper portion of a demethanizer and the liquid from the separator going to the lower portion of a demethanizer. Such a system is not particularly efficient, however. Accordingly, attempts have been made to improve the efficiency simply by utilizing two or more expanders in series. However, even with multiple expanders in series, such separations are still difficult. For one thing, the subsequent demethanizer, must be rather large. Also, sufficient work may not be extracted from the system by means of the expanders even with the two or more in series to be sufficient to handle all of the compression requirements and to supply all the refrigeration needs of the overall plant.

SUMMARY OF THE INVENTION

It is an object of this invention to increase the total horsepower output of the expanders in a gas processing plant; it is a further object of this invention to increase the amount of refrigeration produced by the process stream; it is a still further object of this invention to simplify the design of the demethanizer column of a natural gas processing plant; and it is still yet a further object of this invention to provide improved separation of ethane from methane in a natural gas processing plant.

In accordance with this invention, liquid from a high pressure separator upstream from the first of at least two expanders in series is passed to a feed separator and flashed with the resulting vapor being combined with the expanded vapor from the first expander.

BRIEF DESCRIPTION OF THE DRAWING

In the drawing, forming a part hereof, there is shown in schematic form a portion of a natural gas plant downstream from a dehydrator employing the invention.

DESCRIPTION OF THE PREFERRED EMBODIMENTS

The principle of this invention wherein the liquid product of a high pressure separator feeding vapor to the first of a series of expanders is flashed and the resulting flashed vapor combined with the expander vapor from the expander is broadly applicable to any separation of higher and lower molecular weight gaseous components (for instance, separating butane and higher from ethane, and the like). However, it will be described hereinafter in terms of the preferred embodiment wherein ethane and higher components are separated from the methane in a dehydrated natural gas stream.

Referring now to the Figure, line 2 carries feed which is a natural gas stream which has been subjected to conventional processes to remove acid gases such as $CO_2$ and $H_2S$ and which has been subjected to conventional dehydration processes to remove water. This natural gas vapor feed line stream is then divided and the first portion passes via gas line 4 to gas-gas residue exchanger 6 for the purpose of recovering refrigeration from the residual gas which is primarily methane. The proportion of the feed passing via line 4 is adjusted by means of a valve 5 so as to efficiently utilize the refrigeration available in the residual gas contained in line 90. The second portion of the feed passes via gas line 8 to product heat exchanger 10 and thence via line 9 to demethanizer bottom reboiler 12 and thence via line 20 to chiller 18, and thence via line 21 through second side reboiler 22 (the first side reboiler will be described hereinafter). The thus cooled feed in line 23 is combined with the cooled feed in line 14 to form combined stream 24 which passes to high pressure separator (first expander inlet separation zone) 26. In the high pressure separator, the liquid is drawn off the bottom via liquid line 32, and the vapor drawn off the top via vapor line 27 and passed to the first expander (expansion zone) 28. Expander 28 drives compressor 30 to produce external work. Of course, expander 28 can drive any mechanical means such as a generator, and the like, if desired. Also, expander 28 and the subsequent expanders can be connected by a common shaft to a single compressor or generator means, if desired, or to separate means as shown herein. The thus cooled expanded fluid stream from first expander 28 is drawn off via line 38.

Liquid drawn off from high pressure separator 26 via line 32 passes through first liquid level control and expansion valve 16 and thence to a flash separation zone 34 operating preferably at essentially the discharge pressure of expander 28. This is the heart of the invention. Instead of passing the liquid directly to a middle or lower portion of demethanizer column (fractionation zone) 48, it has been found that substantial advantages are obtained if it is passed through an expansion valve to a feed separator with the flashed vapor being taken off as shown via line 36 and combined with the expansion vapor from the first expander carried by line 38. This puts more volume through the second expander (to be described hereinbelow) thus giving a gain in horsepower output that would otherwise be lost in the flash down to column pressure. Also, the demethanizer column operates more efficiently with this vapor being removed and actually can be constructed with a smaller diameter as a result thereof. The liquid from feed separator 34 passes via line 43 through second liquid level control and expansion valve 44 and thence via line 46 to demethanizer column 48. The combined flashed vapor and expansion vapor stream 40 which may contain some liquid is split and the first portion passes via cold exchange gas line 41 to cold gas exchanger 42, which serves to both recover refrigeration from the very cold gas from the top of the demethanizer and to cool stream 41. The second portion of stream 40 passes via line 50 to first side reboiler 52. The fluids from exchanger 42 and reboiler 52 are withdrawn by lines 53 and 51, respectively, and passed via combined stream line 54 to low pressure separator (second expander inlet separation zone) 56. Low pressure separator 56 operates as an expander inlet separator for the second expander in the same manner that high pressure separator 26 operates as the expander inlet separator for the first expander 28. The vapor from separator 56 passes via vapor line 58 to second expander 60 which drives compressor 62. The vapor (which may contain some liquid) from expander 60 is withdrawn via line 64 and passed to a demethanizer 48. The liquid is withdrawn from separator 56 via line 68, passed through third liquid level control and expansion valve 66, and thence to demethanizer 48 via line 69. Generally this entry point is below the entry of line 64 although lines 64 and 69 can be combined.

Liquid is withdrawn from demethanizer 48 via line 70 and passed to first side reboiler 52 where it picks up sufficient heat to heat this portion of the demethanizer column 48 on being returned thereto via lines 72 and 46. A second liquid stream is withdrawn from demethanizer 48 via line 74 and passed to second side reboiler 22 where it picks up sufficient heat to heat the lower intermediate portion of demethanizer column 48 on being passed back thereto via line 76. A third liquid stream is withdrawn from demethanizer 48 via line 78 and passed to demethanizer bottom reboiler 12 where it picks up sufficient heat to heat the bottom of demethanizer 48 on being returned thereto via line 80.

Finally, the bottom product from demethanizer 48 which is predominantly ethane is withdrawn via line 82 and passed by pump 84 and line 85 to product heat exchanger 10 where it is heated to essentially ambient temperature and discharged via line 86 as product of the process.

The residue gas from the top of the demethanizer 48 is withdrawn via line 88. This residue gas is primarily methane and nitrogen and is passed through cold gas exchanger 42 and gas-gas residue exchanger 6 where it is heated to the desired temperature for discharge. Residue stream 90 generally is compressed by means of compressors 30 and 62 and used in this form as a fuel source, i.e., natural gas for firing furnaces, and the like.

The chiller 18 is cooled generally by some external source, such as propane refrigerant. Except for this and pump 84 which may be powered by a relatively small electric motor, most of the energy for this operation comes from the potential energy stored in the feed gas as a result of it being under compression.

The initial pressures for feed line 2 are in the neighborhood of 730 to 750 psia (5.03 to 5.17 MPa) and are reduced to pressures in the neighborhood of 480 to 490 psia (3.31 to 3.38 MPa) after passing through the first expander and to 200 psi (1.38 MPa) after passing through the second expander. The invention is applicable to systems, however, having initial pressure in the range of 400 to 1,000 psia (2.76 to 6.89 MPa), preferably 500 to 875 psia (3.45 to 6.03 MPa). The demethanizer pressures can vary from 50 to 450 psia (0.34 to 3.1 MPa), preferably from 100 to 350 psia (0.689 to 2.4 MPa). Generally, the pressure after the first expander will be controlled such that: (1) there is the same drop in pressure after each expander; or (2) the same horsepower is obtained from each expander; or (3) a relatively constant ratio of expansion is obtained. As shown in the following example, a constant drop in pressure is used (about 275 psia).

Feed pressures are frequently about 5 MPa, fractionator pressures about 1.4 MPa, and the pressure between the two expanders about 3 MPa.

The invention can be utilized with more than two expanders in a series, either with a feed separator after all but the last one or after only one of the initial expanders.

The following example is based on calculations which have been found to agree closely with typical operating conditions in actual operation.

EXAMPLE

A natural gas stream is passed through a conventional process for removing acid gases and, thence, through a conventional process for dehydration and then to a plant as shown in the drawing. The pressures and temperatures of the various streams are as shown in Table I and the material balance in moles per day are shown in the Table II.

Table I

| Stream No. | Temperature °F. | Temperature °C. | Pressure Psia | Pressure MPa |
|---|---|---|---|---|
| 2 | 90 | 32 | 750 | 5.17 |
| 14 | −57 | −49 | 730 | 5.03 |
| 9 | 56 | 13 | 745 | 5.14 |
| 20 | 25 | −4 | 740 | 5.10 |
| 21 | −23 | −31 | 735 | 5.06 |
| 23 | −48 | −44 | 730 | 5.03 |
| 24 | −51 | −46 | 730 | 5.03 |
| 27 | −51 | −46 | 730 | 5.03 |
| 32 | −51 | −46 | 730 | 5.03 |
| 38 | −81 | −63 | 485 | 3.34 |
| 36 | −70 | −57 | 490 | 3.38 |
| 43 | −70 | −57 | 490 | 3.38 |
| 40 | −80 | −61 | 485 | 3.34 |
| 53 | −119 | −84 | 480 | 3.31 |
| 51 | −117 | −83 | 480 | 3.31 |
| 54 | −119 | −84 | 480 | 3.31 |
| 58 | −119 | −84 | 480 | 3.31 |
| 68 | −119 | −84 | 480 | 3.31 |
| 64 | −168 | −111 | 200 | 1.38 |
| 70 | −134 | −92 | 200 | 1.38 |
| 72 | −92 | −69 | 200 | 1.38 |
| 46 | −99 | −73 | 200 | 1.38 |
| 74 | −71 | −57 | 200 | 1.38 |
| 76 | −32 | −36 | 200 | 1.38 |
| 78 | −2 | −19 | 200 | 1.38 |
| 80 | 21 | −6 | 200 | 1.38 |
| 82 | 21 | −6 | 200 | 1.38 |
| 86 | 80 | 27 | 456 | 3.14 |

Table II

MATERIAL BALANCE, KG MOLS/DAY

| Stream No. | 2 | | 4 | 8 | 27 | 32 | 36 | 43 | 41 |
|---|---|---|---|---|---|---|---|---|---|
| Component | Feed | % | Gas To Residue Exchanger | Gas To Product Heater | Gas To First Expander | Liquid To Flash Separation | Flash Vapor | Flash Liquid | Cold Exchanger Gas |
| Nitrogen | 1,857 | 2 | 557 | 1,300 | 1,593 | 264 | 182 | 82 | 1,278 |
| Methane | 78,349 | 71 | 23,505 | 54,844 | 52,873 | 25,476 | 9,210 | 16,266 | 44,712 |
| Ethane | 16,675 | 15 | 5,002 | 11,673 | 4,503 | 12,172 | 697 | 11,475 | 3,744 |

Table II-continued

| MATERIAL BALANCE, KG MOLS/DAY | | | | | | | | | |
|---|---|---|---|---|---|---|---|---|---|
| Propane | 9,255 | 8 | 2,777 | 6,478 | 881 | 8,374 | 99 | 8,274 | 706 |
| i-Butane | 1,139 | 1 | 342 | 797 | 46 | 1,093 | 4 | 1,089 | 36 |
| N-Butane | 2,590 | 2 | 777 | 1,813 | 77 | 2,513 | 6 | 2,507 | 60 |
| $C_5$+ | 903 | 1 | 270 | 633 | 8 | 895 | — | 895 | 6 |
| Totals | 110,768 | | 33,230 | 77,538 | 59,981 | 50,787 | 10,198 | 40,588 | 50,542 |

| Stream No. | 50 | 58 | 68 | 70 | 74 | 78 | 82 | 88 |
|---|---|---|---|---|---|---|---|---|
| Component | Gas To Side Reboiler #1 | Gas To Second Expander | Low Pressure Separator Liquid | De-$C_1$ Liquid to 1st. Side Reboiler | De-$C_1$ Liquid To 2nd. Side Reboiler | De-$C_1$ Liquid To Reboiler | Demethanized Product | Residue Gas |
| Nitrogen | 497 | 1,599 | 176 | 3 | — | — | — | 1,857 |
| Methane | 17,371 | 45,197 | 16,886 | 5,255 | 6,319 | 1,503 | 477 | 77,872 |
| Ethane | 1,456 | 1,208 | 3,992 | 6,604 | 19,974 | 21,558 | 15,891 | 784 |
| Propane | 274 | 56 | 925 | 1,121 | 9,669 | 10,123 | 9,251 | 4 |
| i-Butane | 14 | 1 | 49 | 53 | 1,154 | 1,180 | 1,139 | — |
| N-Butane | 23 | 1 | 82 | 88 | 2,613 | 2,655 | 2,590 | — |
| $C_5$+ | 2 | — | 8 | 9 | 904 | 910 | 903 | — |
| Totals | 19,637 | 48,062 | 22,118 | 13,133 | 40,633 | 37,929 | 30,251 | 80,517 |

While this invention has been described in detail for the purpose of illustration, it is not to be construed as limited thereby but it is intended to cover all changes and modifications within the spirit and scope thereof.

We claim:

1. A process comprising:

(a) passing a first fluid stream to a first expander inlet separation zone;

(b) withdrawing a vapor stream from an upper portion of said first expander inlet separation zone and passing said vapor stream to a first expansion zone where said vapor stream is expanded to cool said vapor stream and produce external work;

(c) withdrawing a thus cooled expanded fluid stream from said first expansion zone;

(d) withdrawing a liquid stream from a lower portion of said first expander inlet separation zone and passing said liquid stream into a flash separation zone operated at a lower pressure than said first expander inlet separation zone;

(e) withdrawing a flashed vapor stream from an upper portion of said flash separation zone;

(f) combining said expanded fluid stream of (c) and said flashed vapor stream of (e);

(g) withdrawing a liquid stream from a lower portion of said flash separation zone;

(h) passing said thus withdrawn liquid stream of (g) to a fractionation zone;

(i) passing said combined stream of (f) to a second expander inlet separation zone;

(j) withdrawing a vapor stream from an upper portion of said second expander inlet separation zone and passing said vapor stream to a second expansion zone where said vapor stream is expanded to cool said vapor stream and produce external work;

(k) withdrawing a thus cooled expanded fluid stream from said second expansion zone and passing said thus cooled fluid stream to a point near an upper portion of said fractionation zone;

(l) withdrawing liquid from a lower portion of said second expander inlet separation zone;

(m) passing the thus withdrawn liquid of (l) to said fractionation zone;

(n) withdrawing a vaporous product from an upper portion of said fractionation zone; and (o) withdrawing a liquid product from the bottom portion of said fractionation zone.

2. A process according to claim 1 wherein said feed is natural gas.

3. A method according to claim 2 wherein said natural gas has been treated to remove acid gases and water.

4. A method according to claim 3 wherein said natural gas comprises methane and smaller amounts of higher molecular weight hydrocarbons.

5. A method according to claim 4 wherein said natural gas comprises predominantly methane with smaller amounts of ethane, propane, butanes, and nitrogen.

6. A method according to claim 1 wherein said vaporous product withdrawn from the upper portion of said fractionation zone is predominantly methane and nitrogen and said liquid product recovered from the bottom portion of said fractionation zone is ethane and higher molecular weight hydrocarbons with only a minor amount of methane present.

7. A method according to claim 6 wherein said feed is introduced at a pressure within the range of 3.45 to 6.03 MPa and said fractionation zone is operated at a pressure within the range of 0.689 to 2.4 MPa.

8. A method according to claim 1 wherein said feed comprises about 2 percent nitrogen, 71 percent methane, 15 percent ethane, 8 percent propane, 1 percent isobutane, 2 percent n-butane, and 1 percent $C_5$+ hydrocarbons, said feed is at a pressure of about 5 MPa, said fractionator is operated at a pressure of about 1.4 MPa, and the pressure between said first and second expansion zones is about 3 MPa.

9. A method according to claim 1 wherein said stream of (m) is introduced to said fractionation column at a point below said stream of (k).

* * * * *